US008944966B2

(12) United States Patent
Miller

(10) Patent No.: US 8,944,966 B2
(45) Date of Patent: Feb. 3, 2015

(54) VARIABLE STRIDE EXERCISE DEVICE

(71) Applicant: Larry D. Miller Trust, Rochester, MI (US)

(72) Inventor: Larry D. Miller, Rochester, MI (US)

(73) Assignee: Larry D. Miller Trust, Rochester, MI (US)

( * ) Notice: Subject to any disclaimer, the term of this patent is extended or adjusted under 35 U.S.C. 154(b) by 91 days.

(21) Appl. No.: 13/922,789

(22) Filed: Jun. 20, 2013

(65) Prior Publication Data

US 2014/0296036 A1 Oct. 2, 2014

Related U.S. Application Data

(60) Provisional application No. 61/807,633, filed on Apr. 2, 2013.

(51) Int. Cl.

| | |
|---|---|
| ***A63B 22/04*** | (2006.01) |
| ***A63B 22/12*** | (2006.01) |
| ***A63B 22/00*** | (2006.01) |
| ***A63B 22/06*** | (2006.01) |
| ***A63B 21/00*** | (2006.01) |
| ***A63B 21/005*** | (2006.01) |
| ***A63B 21/008*** | (2006.01) |

(52) U.S. Cl.

CPC ..... *A63B 22/001* (2013.01); *A63B 22/0664* (2013.01); *A63B 21/00018* (2013.01); *A63B 21/0056* (2013.01); *A63B 21/0081* (2013.01); *A63B 2022/0676* (2013.01)

USPC ..... 482/52

(58) Field of Classification Search

CPC ..... A63B 22/0064

USPC ..... 482/52

See application file for complete search history.

(56) References Cited

U.S. PATENT DOCUMENTS

| | | | | |
|---|---|---|---|---|
| 7,507,184 | B2 * | 3/2009 | Rodgers, Jr. | 482/52 |
| 7,678,025 | B2 | 3/2010 | Rodgers, Jr. | |
| 7,811,208 | B2 | 10/2010 | Rodgers, Jr. | |
| 8,092,351 | B1 | 1/2012 | Rodgers, Jr. | |
| 2004/0266587 | A1 | 12/2004 | Miller | |

* cited by examiner

*Primary Examiner* — Loan H Thanh
*Assistant Examiner* — Rae Fischer

(57) ABSTRACT

An adaptive exercise device includes a frame which supports swing arms which provide for horizontal motion of associated foot links. A crank system provides for vertical motion of the foot links and is movable relative to the frame. The vertical and horizontal motions of the foot links are mechanically decoupled and may be blended to approximate a desired foot path. The movable crank system causes the foot path to correspond to a natural running action.

7 Claims, 9 Drawing Sheets

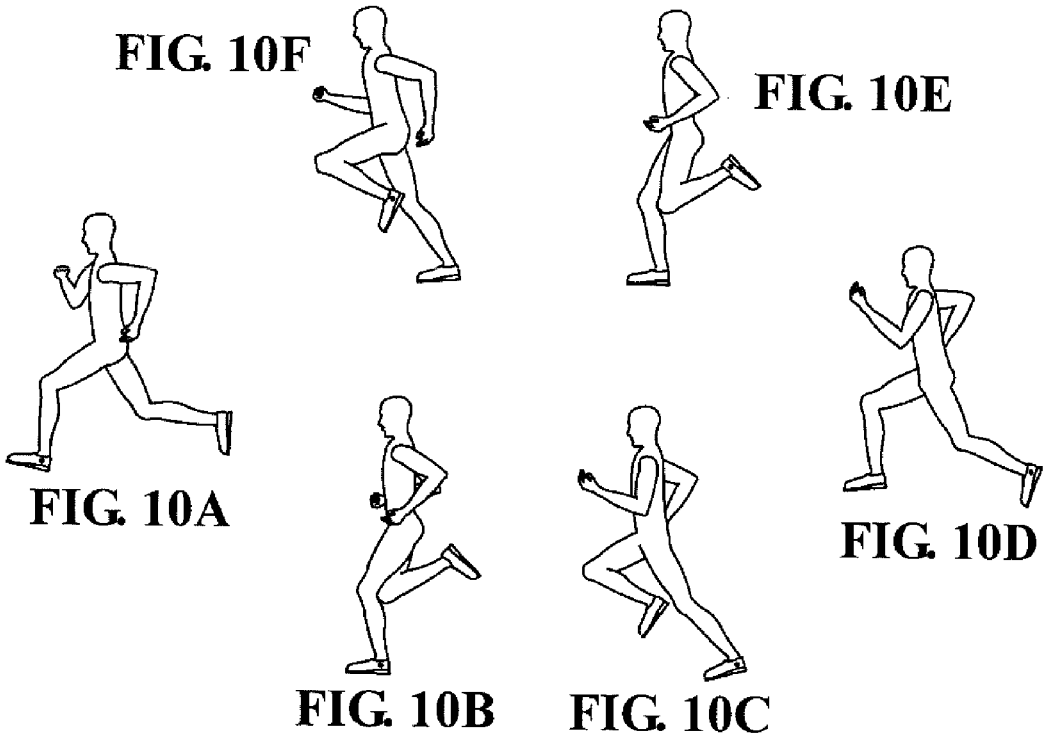
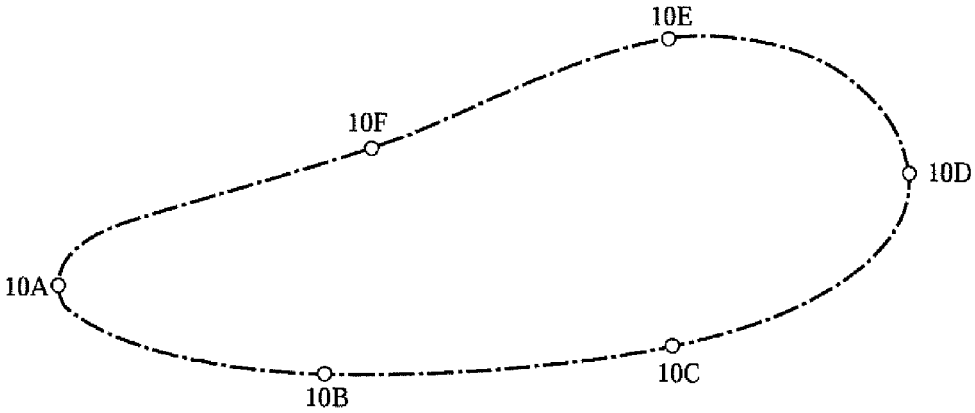
FIG. 11

VARIABLE STRIDE EXERCISE DEVICE

CROSS-REFERENCE TO RELATED APPLICATIONS

This application claims priority to U.S. Provisional Application 61/807,633 filed Apr. 2, 2013, and entitled "Variable Stride Exercise Device," the contents of which are incorporated herein by reference.

FIELD OF THE INVENTION

This invention relates to adaptive exercise devices, and in particular to adaptive exercise devices which separate the vertical and horizontal components of a user's foot motion so as to allow them to be independently varied to create a path of travel for the user's foot which closely approximates a natural running motion.

BACKGROUND OF THE INVENTION

There are a number of exercise devices which operate to allow a user to implement a foot action which follows a generally closed, curved path of travel which simulates running and/or walking. These devices are generally referred to as "elliptical" exercise devices. In a first generation of elliptical devices, the path of travel of the user's foot was predetermined and could not be varied while the device was in use. To the extent any variation or adjustment of foot path was desired, it would be accomplished by adjustment of the geometry of the components of the exercise device. A second generation of elliptical exercise devices is termed "adaptive" exercise devices and they are configured so that the vertical and horizontal components of a user's foot motion may be separately varied while the device is in use so as to allow for selectable control of the path of foot travel. Some such adaptive exercise devices are shown in U.S. Pat. Nos. 7,678,025; 7,507,184; 7,811,208; and 8,092,351. While prior art adaptive exercise devices do allow a user to adjust his or her foot path while actively exercising, it has been found that such adjusted foot paths still do not fully approximate a natural running and stepping motion.

As will be explained in detail hereinbelow, the present invention is directed to further improvements in adaptive exercise devices which allow a user's feet to travel along a path conforming to a natural running and stepping motion. As will be explained in detail hereinbelow, the system of the present invention is mechanically simple, reliable, and easy to use. These and other advantages of the invention will be apparent from the drawings, discussion, and description which follow.

SUMMARY OF THE INVENTION

Disclosed is an adaptive exercise device which includes a frame which is configured to be supported on a horizontal surface. The device includes a first and a second swing arm each of which is pivotally supported on the frame so as to reciprocate relative thereto. The device includes a first and a second foot link each of which is configured to support a user's foot thereupon. Each foot link is pivotally connected to a respective one of the first and second swing arms so that when the swing arms reciprocate relative to the frame they each cause their respective foot support link to move in a path of travel having a substantially horizontal component of motion. The device includes a crank system which is mechanically coupled to the first and second foot support links. The crank system operates to move the foot support links in a path of travel having a substantially vertical component of motion. The crank system is not affixed to the frame, but is movable relative to the frame so that its center of rotation can move in a reciprocal path of travel relative to the frame. The movable crank system operates in cooperation with the remaining components of the device to provide a natural foot motion.

In particular embodiments, the crank system is mounted on a pivot arm which in turn is pivotally supported on the frame. The crank system is coupled to the foot support links by a coupling assembly which includes at least one cable, and which in particular instances can also include at least one rocker arm. A resistance device such as a flywheel, magnetic or electromagnetic brake, spring-operated brake, frictional device, fan device, or the like may be incorporated into the exercise device so as to allow a user to control the resistance of the device. In some embodiments, the device includes a flywheel which is mechanically coupled to, or otherwise associated with, the crank system.

BRIEF DESCRIPTION OF THE DRAWINGS

FIGS. 10A-10F show a runner at various stages in a stride; and

FIG. 11 shows the path of foot travel achieved by the runner in FIGS. 10A-10F.

DETAILED DESCRIPTION OF THE INVENTION

Figure 1:
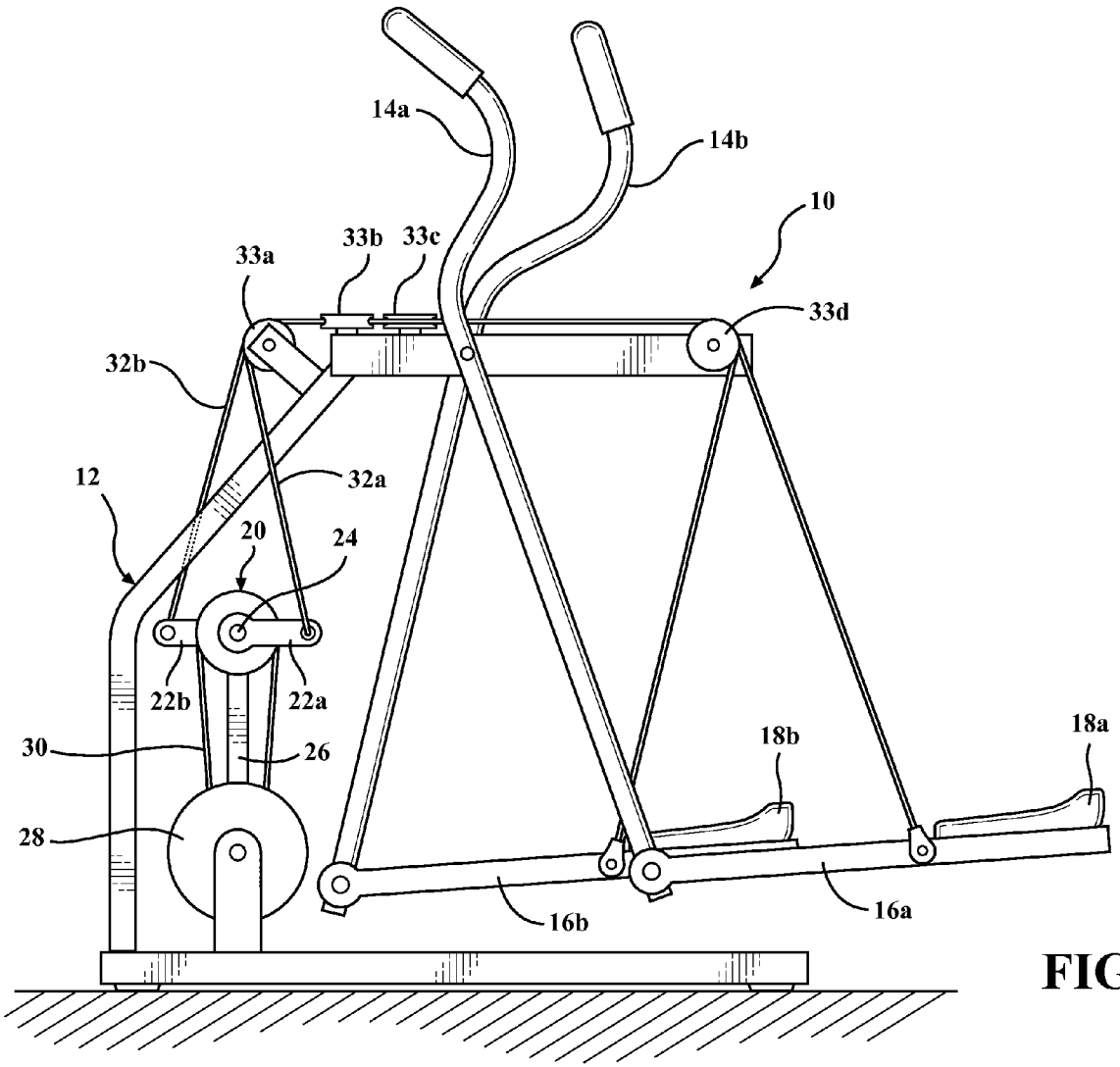
FIG. 1 shows one particular embodiment of exercise device in accord with the present invention.
Figure 2:
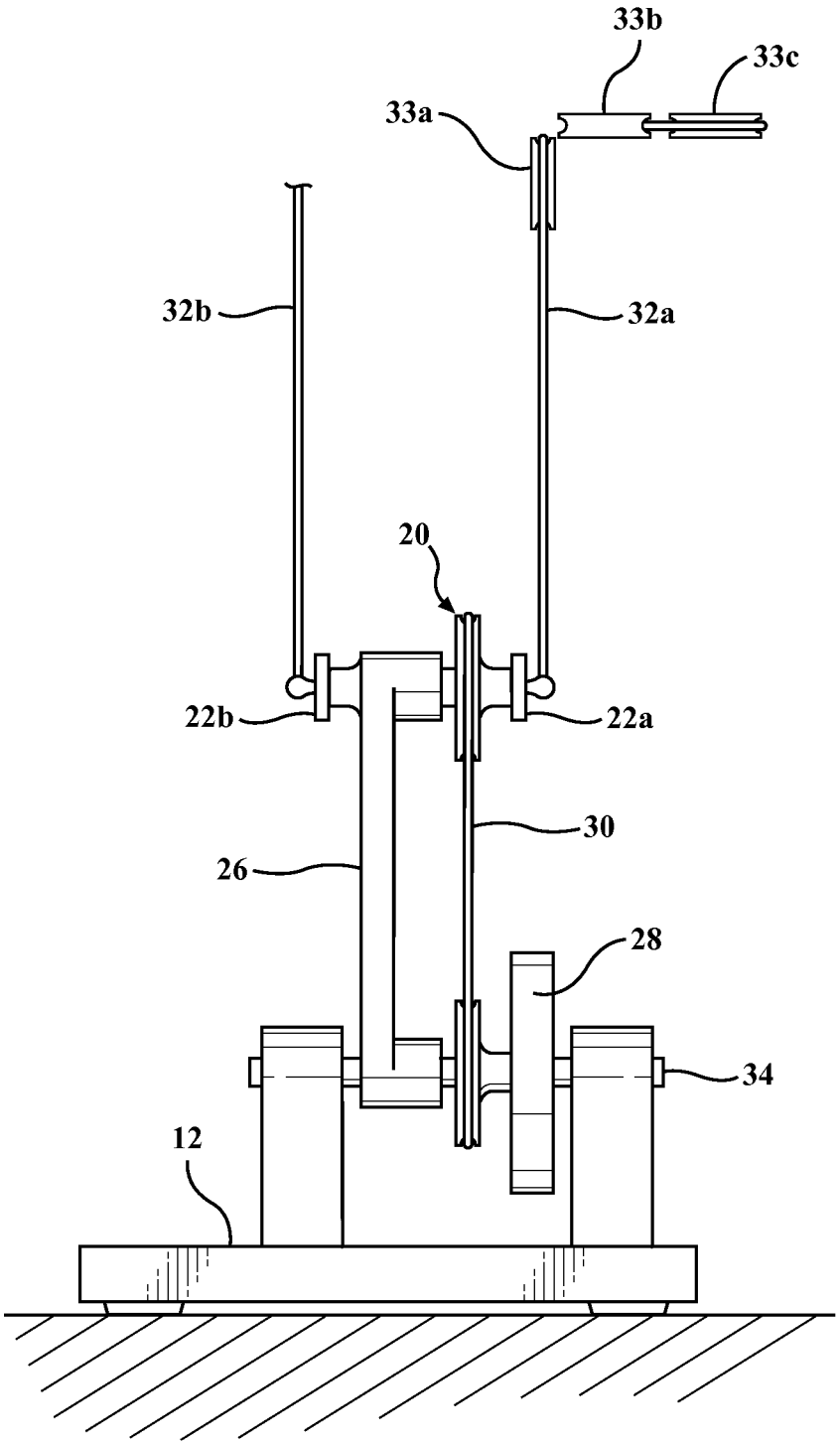
FIG. 2 is a partial front view of the device of FIG. 1 illustrating the crank system thereof.

The present invention will be explained with reference to some particular embodiments, and it is to be understood that yet other embodiments, modifications, and variations thereof will be apparent to those of skill in the art in view of the teaching presented herein. FIG. 1 shows a first embodiment of exercise device 10 structured in accord with the principles of the present invention. The device includes a frame 12 which is configured and operative to retain and support the various other components of the device on a horizontal surface such as a floor. The frame is typically fabricated from metal and/or composite materials and/or wood. Pivotally supported on the frame are a first swing arm 14*a* and a second swing arm 14*b*. As shown in FIG. 2, these swing arms include handgrip portions, although the grips are optional and may be eliminated in some other embodiments. The swing arms 14*a*, 14*b* are pivotally supported on the frame so as to be capable of reciprocating relative thereto. As is known in the art, the reciprocal motion of the swing arms 14*a*, 14*b* may be synchronized via gearing or the like to assure that the motion of these links is equal in magnitude and opposite in travel. Each swing arm has a respective foot support link 16*a*, 16*b* pivotally connected thereto. The foot support links are each configured to retain and support a user's foot when the device is in use and as shown herein include foot engaging portions 18*a*, 18*b* defined thereupon, although these foot supporting portions may be eliminated in some embodiments, in which instance the user's foot will rest directly upon the foot support links 16*a*, 16*b*.

The device 10 of FIG. 2 further includes a crank system 20 having a first crank arm 22*a* and a second crank arm 22*b* associated therewith. The crank arms 22*a*, 22*b*, as will be explained hereinbelow, rotate about a center of rotation 24. It is a significant feature of the present invention that the crank system 20 is capable of moving relative to the frame so that the center of rotation thereof defines a reciprocal path of travel relative to the frame. In this particular embodiment, the crank system 20 is mounted on a pivot arm 26, which in turn is affixed to the frame 12. As will further be seen from FIG. 1, in this embodiment the crank system 20 is mechanically coupled to a flywheel 28 by means of a drive belt 30. The flywheel 28 is optional and can function to provide for a smoother mechanical motion of the device while also providing for some mechanical resistance which increases the exercise benefit thereof. Other resistance devices such as magnetic devices, electromagnetic devices, frictional devices, spring systems, hydraulic systems, and fan-based systems may similarly be employed. Also, it should be noted that various resistance devices may also be associated with the swing arms. As will further be seen from FIG. 1, the crank arms 26*a*, 26*b* are each mechanically coupled to a respective foot support link 18*a*, 18*b* by cables 32*a*, 32*b*, which pass over a series of pulleys 33*a*-33*d*.

Referring now to FIG. 2, there is shown a partial front view of the device 10 of FIG. 1 better illustrating the crank system 20; crank arms 22*a*, 22*b* thereof; pivot arm 26; flywheel 28; belt 30; cables 32*a*, 32*b*; and pulleys 33*a*-22*c*. As will further be seen, the flywheel 28 and pivot arm 26 are supported on the frame 12 by an axle 34.

As will be apparent from FIG. 1, the swing arms 14*a*, 14*b* cooperate with the crank system 20 and associated cables 32*a*, 32*b* to support and retain the foot support links 16*a*, 16*b*. As will be explained in detail hereinbelow, the swing arms 14*a*, 14*b* provide for substantially horizontal motion of the foot support links while the crank system 20 provides for substantially vertical motion of the foot links; and it is this combination of motions which allows a user to achieve a desired path of foot travel. In the present invention, the action of the crank system 20 and swing arms 14*a*, 14*b* are decoupled, and hence mechanically independent, thereby allowing a user to blend horizontal and vertical motions of the foot support links 16*a*, 16*b* so as to achieve a desired path of foot travel.

Figure 3:
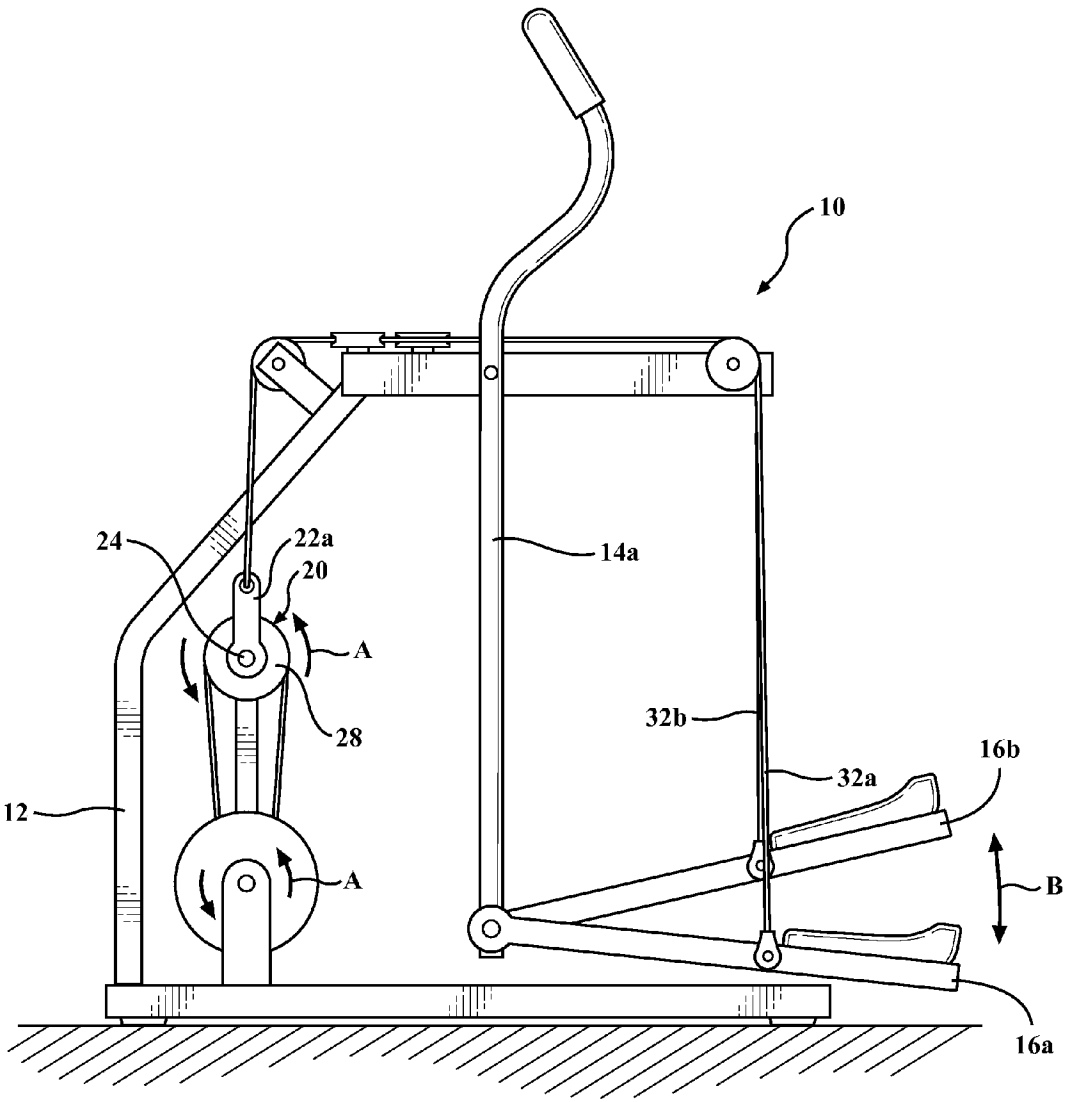
FIG. 3 shows the device of FIG. 1 in which the crank system is operating so as to provide for vertical motion of the foot support links.
Figure 4:
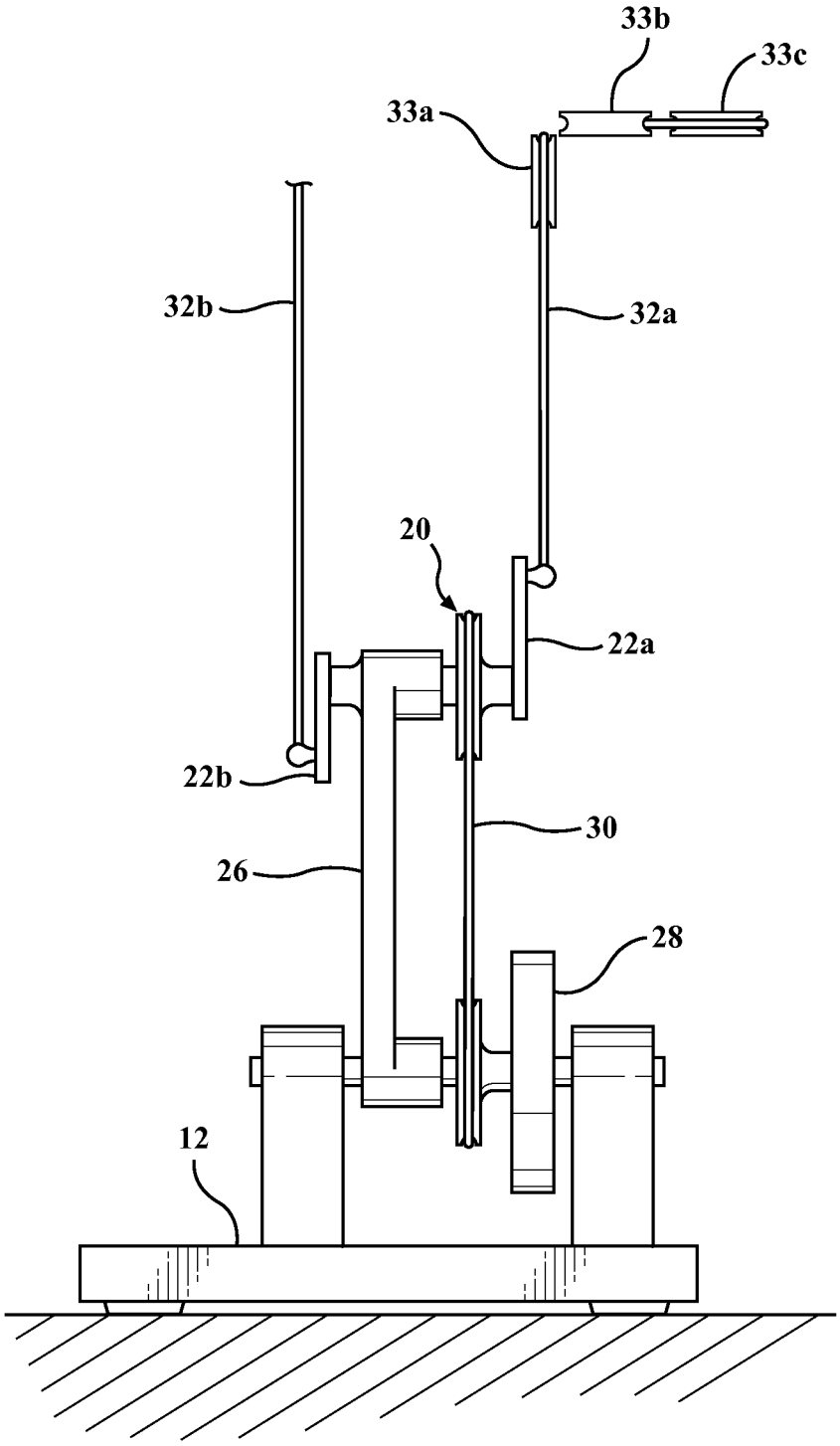
FIG. 4 is a partial view of the device of FIG. 3 showing the position of the crank system.

Referring now to FIG. 3, there is shown the device 10 of FIG. 1 operating in a mode wherein the crank system 20 is moving the foot links in a substantially vertical path of travel; and as will be seen, this can occur without any corresponding motion of the swing arms. As shown, the crank system 20 rotates the crank arms 22*a*, 22*b* (not visible in this view) as indicated by the associated curved arrows A. It is further to be noted that this motion also rotates the flywheel 28. As the crank arms move about the center of rotation 24 they alternately move the cables 32*a*, 32*b* to raise and lower the foot support links 16*a*, 16*b* in a path of travel shown by arrow B. As noted above, this path is described as having a "substantially vertical" component of motion, and this recognizes the fact that the path, though very slightly curved, includes a vertical component which is the major component of motion provided by action of the crank system. Typically, the vertical component of the total motion is at least eight times greater than any horizontal component of the motion The motion provided to the foot support links 16*a*, 16*b* by the crank system is mechanically independent of any fore-aft motion provided to the foot support links 16*a*, 16*b* by the swing arms, 14*a*, and 14*b*. FIG. 4 corresponds to FIG. 3 and shows a front view of the crank system 20; associated crank arms 22*a*, 22*b*; associated cables 32*a*, 32*b*; and other components including the pivot arm 26, flywheel 28, belt 30, and frame 12.

As mentioned above, the swing arms 14*a*, 14*b* allow for the motion of the foot support links along a fore and aft path of travel. This path, while very slightly curved owing to the pivoting of the swing arms, will have a substantially horizontal component of motion (typically more than eight times any vertical motion provided by the swing arms). The combination of vertical and horizontal motion of the foot support links combine to provide the user's foot with a path of travel which may be selectively varied between entirely horizontal motion, entirely vertical motion, and combinations thereof which yield closed paths of travel which are variously curved. The fact that the vertical and horizontal components of motion are mechanically decoupled from one another allows for the user to selectively vary the ratio of these two components of motion. Furthermore, as will be explained hereinbelow, the fact that the center of rotation 24 of the crank system 20 reciprocates relative to the frame 12 during the use of the device further modifies the foot action so as to better approximate a natural running and stepping motion.

Figure 5:
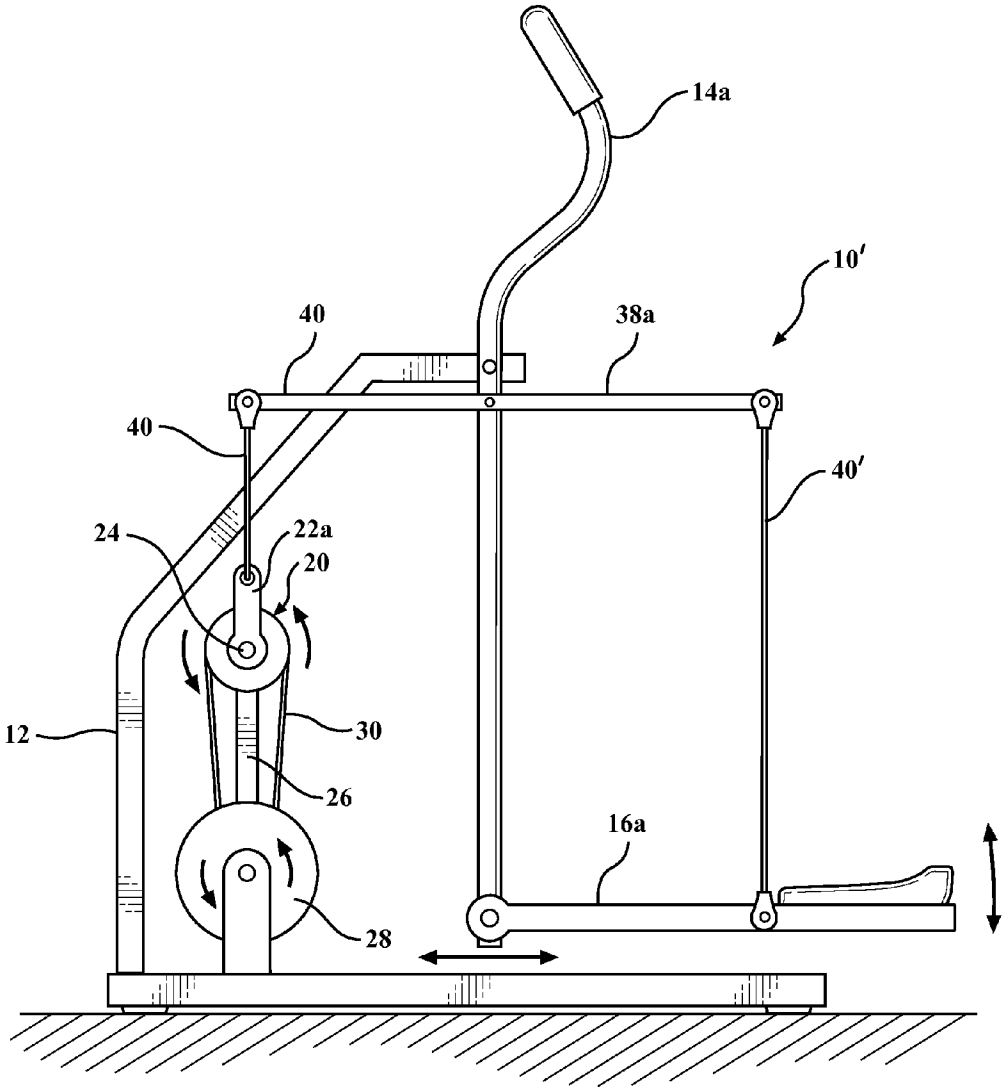
FIG. 5 shows another embodiment of device of the present invention.

Referring now to FIG. 5, there is shown another embodiment of exercise device 10' of the present invention. This embodiment is generally similar to that shown with regard to FIG. 1, and like components are illustrated by like reference numerals. In this regard, the FIG. 5 embodiment includes a frame 12; swing arms 14*a* and 14*b* (not visible in this drawing); foot support links 16*a* and 16*b* (not visible in this drawing); and a crank system 20 having crank arms 22*a* and 22*b* (not visible in this drawing) which rotate about a center of rotation 24. As in the previous embodiment, the crank system 20 is supported separate from the frame 12 by a pivot arm 26 and has an optional flywheel 28 and drive belt 30 associated therewith. Where the FIG. 6 embodiment differs from that of FIG. 1 is in that the crank arms are coupled to their respective foot links by a coupling assembly which, in addition to incorporating cables, further includes a rocker arm which substitutes for a portion of the cable shown in the FIG. 1 embodiment. As specifically shown in FIG. 6, a rocker arm 38*a* connects crank arm 22*a* to foot support link 16*a* by means of cable segments 40, 40'. The second foot link and crank arm, which are not visible in this view, are coupled by a system including a second rocker arm also not visible.

FIGS. 6A-7C show one full cycle of rotation of the crank system of a device generally similar to that of FIG. 1, and illustrate the reciprocal motion of the center of rotation 24 of the crank system 20. The cycle begins with FIG. 6A which shows the device in a configuration in which the two foot links are in an approximately equal and horizontal orientation, and the rightmost foot link 16*b* is beginning to travel downward and the leftmost foot link 16*a* is beginning to travel upward. As will be seen, cable 32*b* is applying a force (indicated by arrow C) to crank arm 22*b* causing the crank system and associated flywheel to rotate in a counterclockwise direction. This combined torque has displaced the center of rotation 24 of the crank system 20 to a leftmost position relative to the frame 12. This displacement of the center of rotation is a significant feature of the present invention, since it effectively changes the relative lengths of the cables 32*a* and 32*b*. so that cable 32*b* is longer than cable 32*a* and will cause the right foot link to be lower and the left foot link to be higher than if this feature were not present. In the case of prior art, fixed-crank systems such as those in the U.S. Pat. No. 7,507,184 referenced above, vertical motion of the foot links causes one cable to move upward, and the other to move downward in an equal amount. As will be discussed below, the displacement of the center of rotation and associated effective change in the relative lengths of the cables changes the relative positions of the foot support links and modifies the user's foot path so as to approximate a more natural running motion. FIG. 6B shows further progress of the cycle; and in this instance, the right foot support link 16*a* has very nearly approached its bottom level of travel along the vertical path and the left foot support link 16*b* has very nearly approached its upper limit of travel along that path. Torque on the crank system 20 is decreasing, and the center of rotation 24 has moves somewhat toward its vertical position. FIG. 6C shows a further progress of motion in which the right foot support link 16*b* has passed its maximum lower vertical limit and is beginning to move upward while, conversely, the left foot support link has passed its maximum upward path of travel and is beginning to move downward. Torque on the crank system has further decreased, and the center of rotation thereof is very near vertical.

Figure 6C:
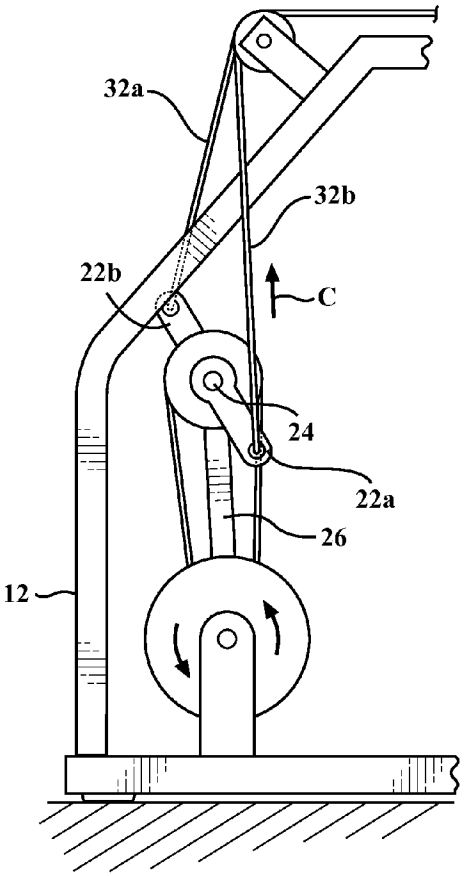
FIGS. 6A-7C show the crank system of the present invention in various orientations, and illustrate the displacement of the center of rotation thereof.
Figure 6B:
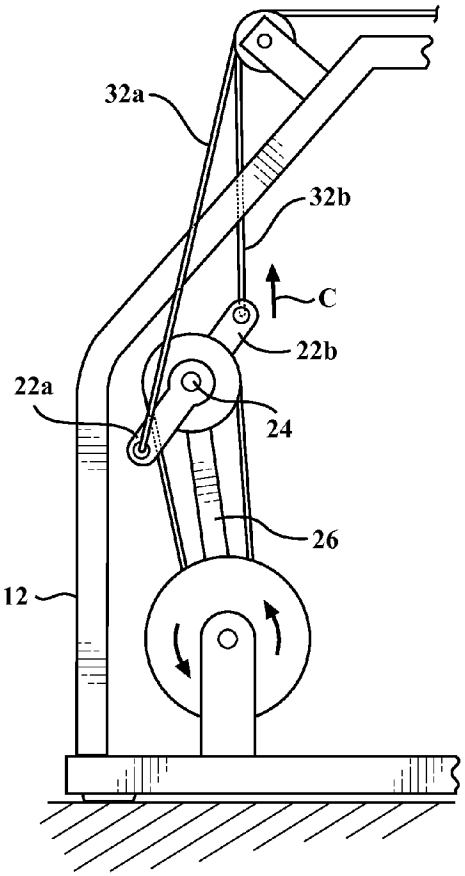
Figure 6A:
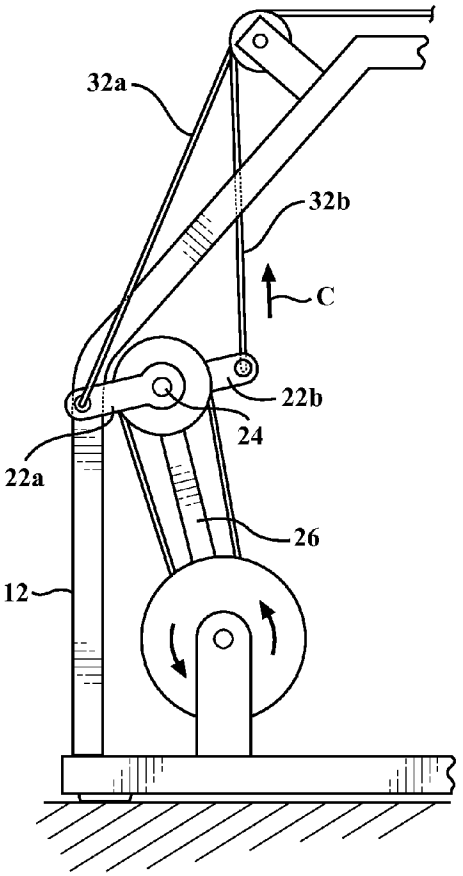
Figure 7C:
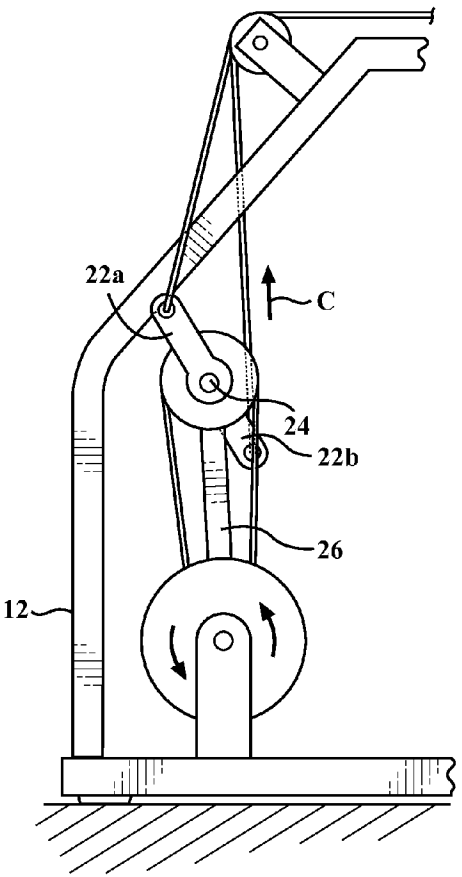
Figure 7B:
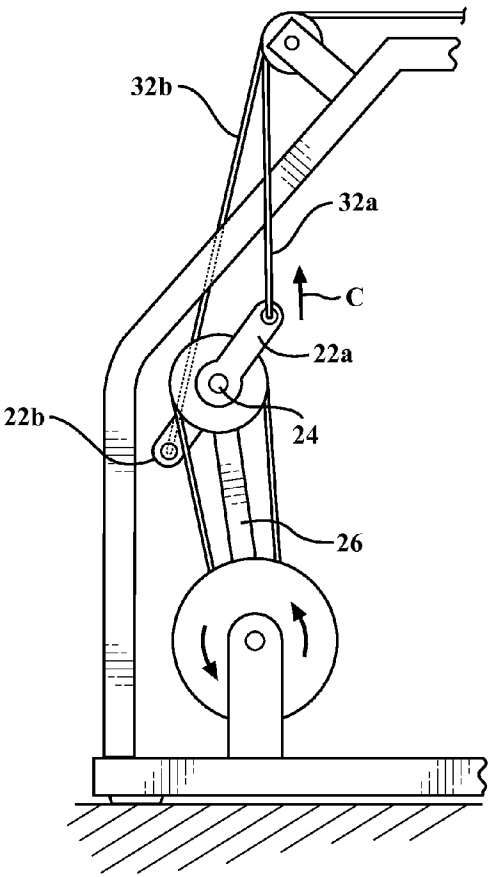
Figure 7A:
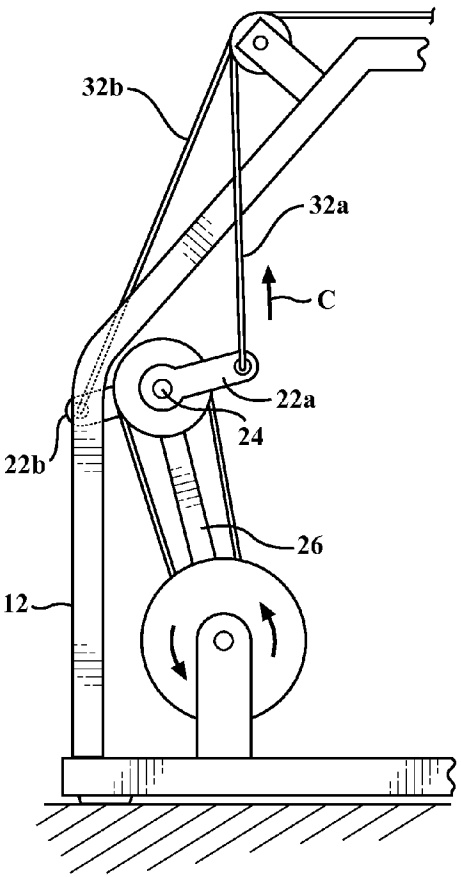

Referring now to FIGS. 7A-7C, there is illustrated the remainder of the cycle; and it will be noted that motions shown therein are mirror images of those in FIGS. 6A-6C. In FIG. 7A, the two foot links are in an approximately equal and horizontal orientation, and the left foot support link 16*a* is moving downward, and the weight of the user at this stage is placing a relatively large torque on the crank system 20 displacing its center of rotation 24 leftward. Conversely, the right foot support link 16*b* is moving upward. FIG. 7B shows a further stage of motion in which the left foot support link 16*a* is approaching its downward limit of motion and the right foot support link 16*b* is approaching its upward limit of motion. As in corresponding FIG. 6B, the center of rotation 24 of the crank system 20 has displaced rightward. FIG. 7C shows a further stage of motion in which the left foot support link 16*a* has passed its downward limit of motion and is moving upward, while the right foot support link 16*b* has passed its upward limit of motion and is moving downward. In FIG. 7C, as in FIG. 6C, the center of rotation 24 of the crank system 20 and associated pivot arm 26 are in a nearly vertical orientation. It has been found, in accord with the present invention that the displacement of the crank system as illustrated in FIGS. 6A-7C causes the foot path achieved by the device to better correspond to a natural motion.

Figure 8:
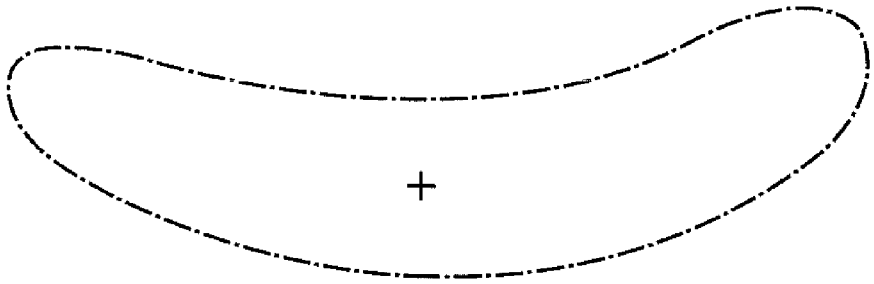
FIG. 8 PRIOR ART
FIG. 8 shows the path of foot travel achieved by a device of the prior art.
Figure 9:
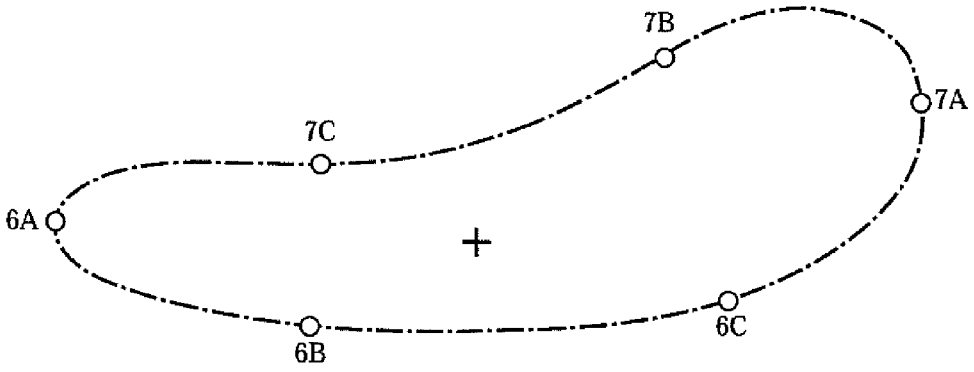
FIG. 9 shows the path of foot travel achieved through the use of the device of the present invention.

FIG. 9 is an illustration of the path of travel of a user's foot as achieved in the use of a device of the present invention, and this path is marked to show the corresponding positional configuration of the crank system as illustrated in FIGS. 6A-7C. FIG. 8 shows the foot motion which would be achieved by that device if the crank system were not free to reciprocate, and as such represents the type of foot motion achieved by prior art devices under identical operating conditions. As will be seen, the reciprocal motion of the crank system causes the user's foot to move in a flatter, lower, forward path of travel through points 7C to 6A to 6B, as compared to the prior art. Likewise, the rearward and upward path of foot travel through points 6C to 7A to 7B is higher and more rounded as compared to the FIG. 8 foot path of the prior art. This improved foot path is the result of the crank arm rotating under the torque pressure applied by the user's weight. The displacement of the crank arm causes the location of the crank pivot location to move relative to the frame and in turn modifies the lengths of cables 32*a* and 32*b*

FIGS. 10A-10F are a series of drawings based upon photographs taken by Eadweard Muybridge, showing a runner in motion. The figures are marked to show the position of the runner's left ankle. FIG. 11 is a graphic depiction of the relative positions of the mark on the user's left ankle corresponding to FIGS. 10A-10F. As will be seen from a comparison of FIG. 9 and FIG. 11, the device of the present invention provides a path of foot travel which very closely approximates that of an actual runner.

The foregoing describes some particular embodiments of the present invention. Other embodiments, modifications, and variations thereof will be apparent to those of skill in the art in view of the teaching presented herein. The foregoing is not meant to be a limitation upon the practice of the present invention. It is the following claims, which include all equivalents, which define the scope of the invention.

The invention claimed is:

1. An exercise device comprising:

a frame configured to be supported on a horizontal surface;

a first and a second swing arm pivotally supported on said frame so as to reciprocate relative thereto;

a first and a second foot support link, each foot support link being configured to support a user's foot thereupon, each foot support link being pivotally connected to a respective one of said first and second swing arms so that when said swing arms reciprocate relative to said frame, they each cause their respective foot support link to move in a path of travel having a substantially horizontal component of motion;

a crank system which is mechanically coupled to said first and second foot support links, and is operative to move said foot support links in a path of travel having a substantially vertical component of motion, said crank system being movable relative to said frame so that a center of rotation thereof can move in a reciprocal path of travel relative to said frame.

2. The exercise device of claim 1, wherein said crank system is mounted on a pivot arm which is pivotally supported on said frame.

3. An exercise device as in claim 1, wherein said crank system is coupled to said first and second foot support links by a coupling assembly which includes at least one cable.

4. The exercise device of claim 3, wherein said coupling assembly further includes at least one rocker arm.

5. The exercise device of claim 2, wherein at least one of said foot support links is coupled to said pivot arm.

6. The exercise device of claim 1, wherein said crank system is coupled to a resistance device.

7. The exercise device of claim 6, wherein said resistance device is selected from the group consisting of: a flywheel, a magnetic resistance device, a frictional resistance device, an electromagnetic resistance device, a hydraulic resistance device, and a fan.

* * * * *